US008186847B2

(12) United States Patent
Hu et al.

(10) Patent No.: US 8,186,847 B2
(45) Date of Patent: May 29, 2012

(54) LED LIGHTING ASSEMBLY

(75) Inventors: Guodong Hu, Ningbo (CN); Zhaoyong Zheng, Ningbo (CN); Wanjiong Lin, Ningbo (CN)

(73) Assignees: Wanjiong Lin, Ningbo (CN); Self Electronics USA Corporation, Norcross, GA (US); Ningbo Self Electronics Co., Ltd., Ningbo (CN)

( * ) Notice: Subject to any disclaimer, the term of this patent is extended or adjusted under 35 U.S.C. 154(b) by 105 days.

(21) Appl. No.: 12/760,667

(22) Filed: Apr. 15, 2010

(65) Prior Publication Data

US 2010/0277908 A1 Nov. 4, 2010

(30) Foreign Application Priority Data

Apr. 30, 2009 (CN) ..... 2009 2 0118897 U

(51) Int. Cl.
*F21S 4/00* (2006.01)

(52) U.S. Cl. ..... 362/225; 362/249.02; 362/240

(58) Field of Classification Search ..... 362/217.01, 362/219, 222, 223, 225, 217.02, 217.12, 362/217.14, 217.15, 221, 227, 230, 231, 362/235, 236, 240, 244, 245, 249.01, 249.02, 362/249.06, 249.16, 304–310, 361, 545, 362/544, 800

See application file for complete search history.

(56) References Cited

U.S. PATENT DOCUMENTS 6,361,186 B1 * 3/2002 Slayden ..... 362/241
6,676,284 B1 * 1/2004 Wynne Willson ..... 362/555
6,761,472 B1 * 7/2004 Cleaver et al. ..... 362/267
6,776,504 B2 * 8/2004 Sloan et al. ..... 362/240
6,851,832 B2 * 2/2005 Tieszen ..... 362/235
6,969,179 B2 * 11/2005 Sloan et al. ..... 362/219
7,159,997 B2 * 1/2007 Reo et al. ..... 362/240
7,448,768 B2 * 11/2008 Sloan et al. ..... 362/145
7,572,027 B2 * 8/2009 Zampini et al. ..... 362/225
7,850,341 B2 * 12/2010 Mrakovich et al. ..... 362/249.06
7,857,482 B2 * 12/2010 Reo et al. ..... 362/225
2006/0146531 A1 * 7/2006 Reo et al. ..... 362/244

* cited by examiner

*Primary Examiner* — Hargobind S Sawhney

(74) *Attorney, Agent, or Firm* — Wang Law Firm, Inc.; Li K. Wang

(57) ABSTRACT

An LED lighting assembly includes an emitting-light apparatus, an inserting apparatus connected electrically to the emitting-light apparatus and a base cover received the emitting-light apparatus. The emitting-light apparatus includes a PCB and at least one LED unit welded on the PCB. The inserting apparatus includes a pedestal and at least two connecting springs received in the pedestal. The base cover has a first side groove and a second side groove. The two ends of the bottom of the base cover have a fixing gap and an inserting slot. The emitting-light apparatus is inserted into the second side groove, the inserting apparatus are inserted into the first side groove, the bottom of the pedestal is received in the fixing gap. The LED lighting assembly can link with another the same, and the distances of the LED units adjacent to other are same.

5 Claims, 3 Drawing Sheets

LED LIGHTING ASSEMBLY

BACKGROUND OF THE INVENTION

1. Field of the Invention

This present invention relates a solid state lighting, and more specifically to an LED lighting assembly.

2. The Related Art

As the luminance of LED improving continually, and the characteristic of the LED is more luminous efficiency, less volume and more colours, so the LED as a light source is used in more and more lamps. And the LED lamp as a lighting lamp or a decorating lamp is more and more used in general life.

A prior LED lamp includes a lamp holder, a circuit board which some LED chips welded on and a light guiding lens, thereof, a jack is welded on one end of the circuit board. At least two LED lamps can connected each other by the jack. Neverheless, while the distance of each couple of LED chips welded on the circuit board is less, and the two LED lamps connect each other, the distance of two LED lamps is larger than the distance of two LED chips anear each other, so when the two LED lamps connected are lighting, a clearly dark zone will be appear, or the two LED light strips are arranged adjacent to each other a dark zone is generated in the connecting zone.

While the LED lamp is used, the dark zone will affect the result of lighting. And the sort of LED lamps cannot connect each other firmly, the LED lamp is easy off for loosing.

SUMMARY OF THE INVENTION

An object of the present invention is to provide an LED lighting assembly, and the lighting assembly is easy and fasten to connect to another the same. The lamp has only less elements.

In order to achieve above purpose, the present invention of the LED lighting assembly includes an emitting-light apparatus, an inserting apparatus and a base cover. The emitting-light apparatus is inserted into the base cover, the emitting-light apparatus connects electrically to the inserting apparatus. The emitting-light apparatus includes a PCB and at least one LED unit welded on the PCB. The inserting apparatus includes a pedestal and at least two connecting springs received in the pedestal. The two sides of the pedestal extend sidely to form two strip inserting ribs, the upper surface of the pedestal forms two receiving grooves which receive the connecting springs. The base cover has a first side groove and a second side groove, the first and second side grooves are opened in the inner side walls of the base cover and showing a strip shape. The two ends of the bottom of the base cover have a fixing gap and an inserting slot. The emitting-light apparatus is inserted into the second side groove, the inserting ribs of the inserting apparatus are inserted into the first side groove, the bottom of the pedestal is received in the fixing gap, the bottom of the pedestal and the bottom of the base cover are level.

The light guiding lens shows a strip shape. The middle of the light guiding lens projects upward to form an emitting body. The two sides of the emitting body extend outside to form respectively a strip fixing rib. A third side groove forms in the inner side wall of the base cover. The fixing ribs inserts into the third side groove and above the emitting-light apparatus.

The fixing hole is arranged in the PCB, a fastening hole is opened in the bottom of the base cover. The emitting-light apparatus is arranged in the base cover, a fixing dowel is inserted into the fastening hole and the fixing hole to fasten the emittig-light apparatus on the base cover.

The bottom of the two ends of the PCB has connecting pins and welding points, the rear of the receiving grooves projects to form at least two fixing poles, the connecting springs are arranged in the receiving grooves. And the rear end of each the connecting spring has a hole which covers around the fixing pole, the connecting springs are welded with the welding points, the bottom of the base cover projects upward to form a convex strip, the bottom of the PCB presses the convex strip.

As above description, when the LED lighting assemblies connected each other are lighting, the light spots on the PCBs are symmetrical, therefore, the two LED lighting assemblies are a single strip lamp in seeing.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
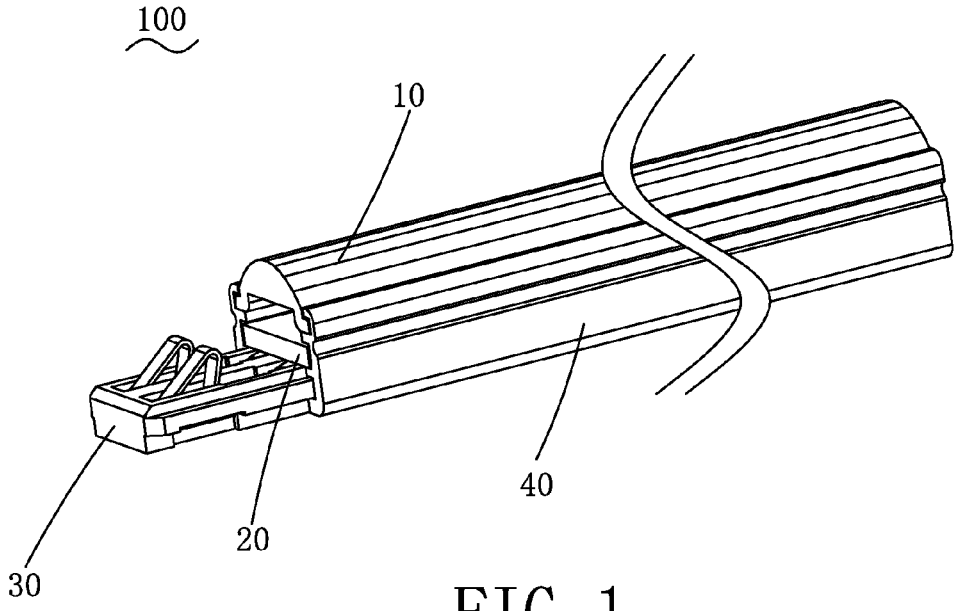
FIG. 1 is a foreward perspective view of an LED lighting assembly of the present invention.
Figure 2:
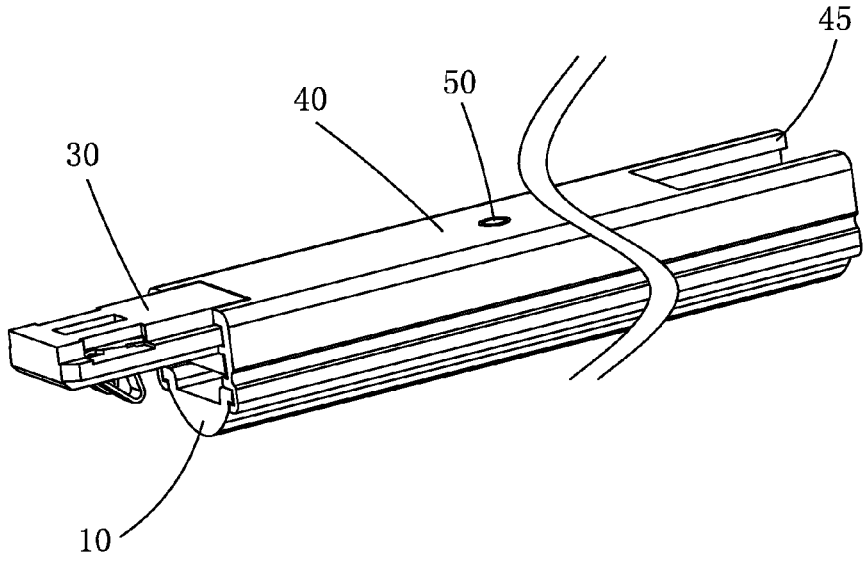
FIG. 2 is a backward perspective view of the LED lighting assembly of the present invention further.

First referring to FIGS. 1 and 2, an embodiment of an LED lighting assembly 100 is a single row model. The single row model of the LED lighting assembly 100 includes a light guiding lens 10, an emitting-light apparatus 20, an inserting apparatus 30 and a base cover 40. the light guiding lens 10 and the emitting-light apparatus 20 are inserted into the base cover 40, the inserting apparatus 30 electrically connects to the emitting-light apparatus 20.

Figure 3:
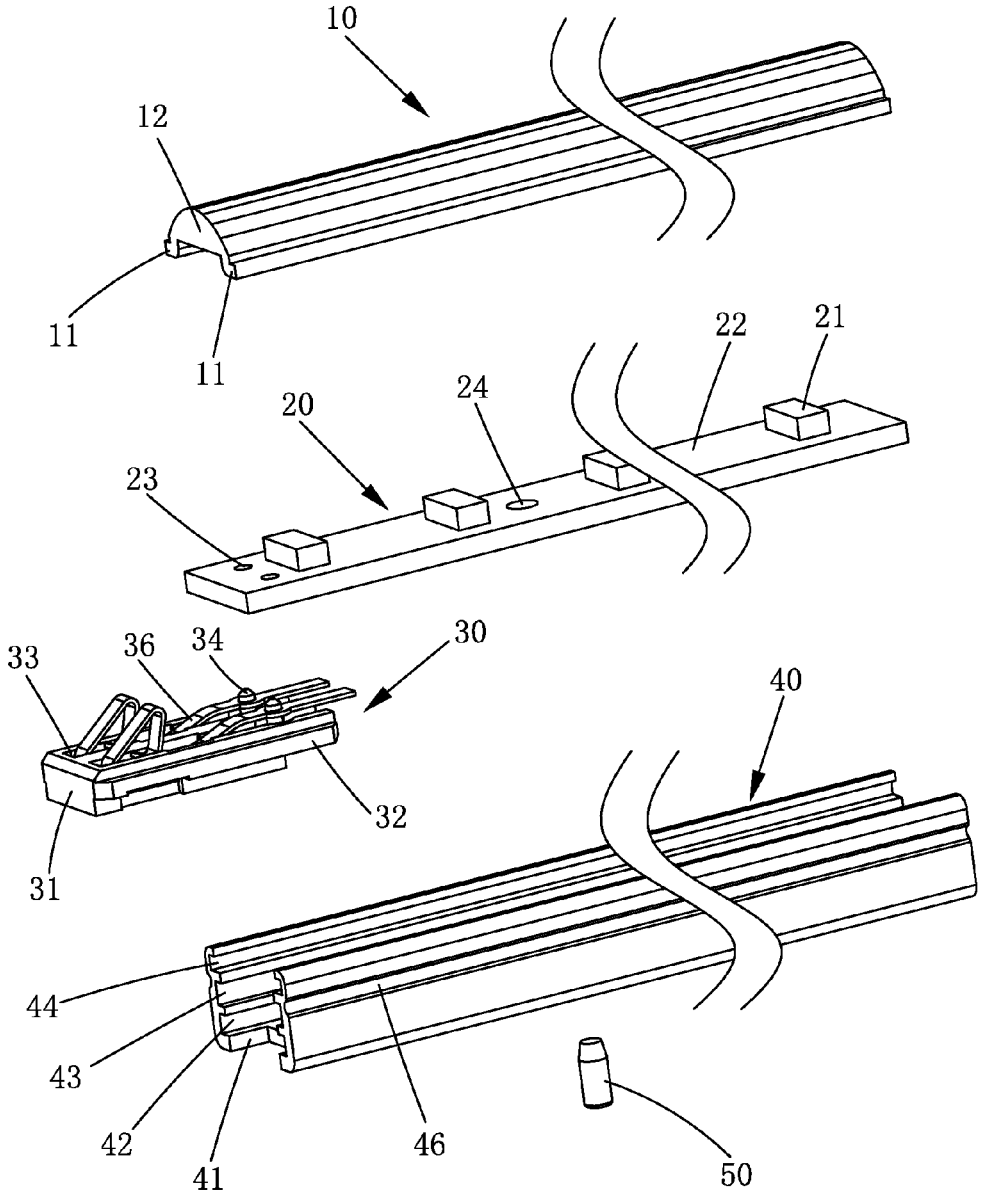
FIG. 3 is an exploded view of the LED lighting assembly.

Please refer to FIG. 3, the light guiding lens 10 is a plano-convex lens in this embodiment. The middle of the light guiding lens 10 projects upward to form an emitting body 12, the two sides of the emitting body 12 extend outside to form respectively a strip fixing rib 11. the emitting-light apparatus 20 includes a strip printed circuit board (PCB) 22 and at least of one LED unit 21. One end of the PCB 22 is being to form two receiving holes 23. The middle part of the PCB 22 arranges a fixing hole 24. The bottom of the two ends of the PCB 22 has connecting pins and welding points. The inserting apparatus 30 includes a pedestal 31 and two connecting springs 36 which are arranged in the pedestal 31. The two sides of the pedestal 31 extend sidely to form two strip inserting ribs 32. The upper surface of the pedestal 31 is being to form two receiving grooves 33. The rear of the receiving grooves 33 projects to form two fixing poles 34. The connecting springs 36 are arranged in the receiving grooves 33, and the rear end of the connecting springs 36 has a hole, therefore the holes cover around the fixing poles 34. The base cover 40 shows a U shape, the two sides of the base cover 40 have a first side groove 42, a second groove 43 and a third groove 44 from bottom to top and symmetrically. The first side groove 42 is used to receive the inserting apparatus 30, the second side groove 43 is used to receive the emitting-light apparatus 20, and the third side groove 44 is used to receive the light guiding lens 10. The two ends of the bottom of the base cover 40 have a fixing gap 41 and an inserting slot 45. Two strip fixing slots 46 are symmetrically arranged in the outside of the base cover 40. A fastening hole is opened in the bottom of the base cover 40, the fastening hole is used to fasten a fixing dowel 50, while the emitting-light apparatus 20 is arranged in the base cover 40, the fixing dowel 50 is inserted to the fastening hole and the fixing hole 24 to fasten the emittig-light apparatus 20 on the base cover 40.

While the single row LED lighting assembly 100 is assembled, the fixing poles 34 are inserted into the receiving holes 23 from bottom to top, the ends of the connecting grooves 36 are welded on the bottom of the PCB 22, and then, the PCB 22 is inserted into the second side groove 43, the pedestal 31 is inserted into the first side groove 42, the inserting ribs 32 are received in the first side groove 42, the bottom of the pedestal 31 is wedged into the fixing gap 41, therefore the bottom of the pedestal 31 and the bottom of the base cover 40 are level. The fixing ribs 11 are inserted into the third side groove 44, the emitting body 12 covers on the LED unit 21. While two single row LED lighting assembly 100 are connected together, the inserting apparatus 30 of the first LED lighting assembly 100 inserts into the first side groove 10 of the second LED lighting assembly 100, the bottom of the pedestal 31 of the first LED lighting assembly 100 inserts into the inserting slot 45 of the second LED lighting assembly 100, the connecting springs 36 connect electrically to the connecting pins which are arranged in the bottom of the PCB 22. The two PCBs 22 of the two LED lighting assemblies 100 are near to each other, so the LED untis 21 are arranged in the two PCBs 22 in equal distance, while the LED lighting assemblies 100 are lighted, the light spots on the PCBs 22 are symmetrical, therefore, the two LED lighting assemblies 100 are a single lamp in seeing.

As abover description, the LED units 21 are need to cool for a long time usage, while the LED units 21 are large power, the base cover 40 is made of metal or alloy, and the bottom of the base cover 40 projects upward to form a convex strip, the bottom of the PCB 22 presses the convex strip, so the heat could be emit by the base cover 40 to debase the working temperature of the LED unit 21. The emitting body 12 may be a V-shape lens. While the emitting angle is large, the light guiding lens 10 could be omitted.

Figure 4:
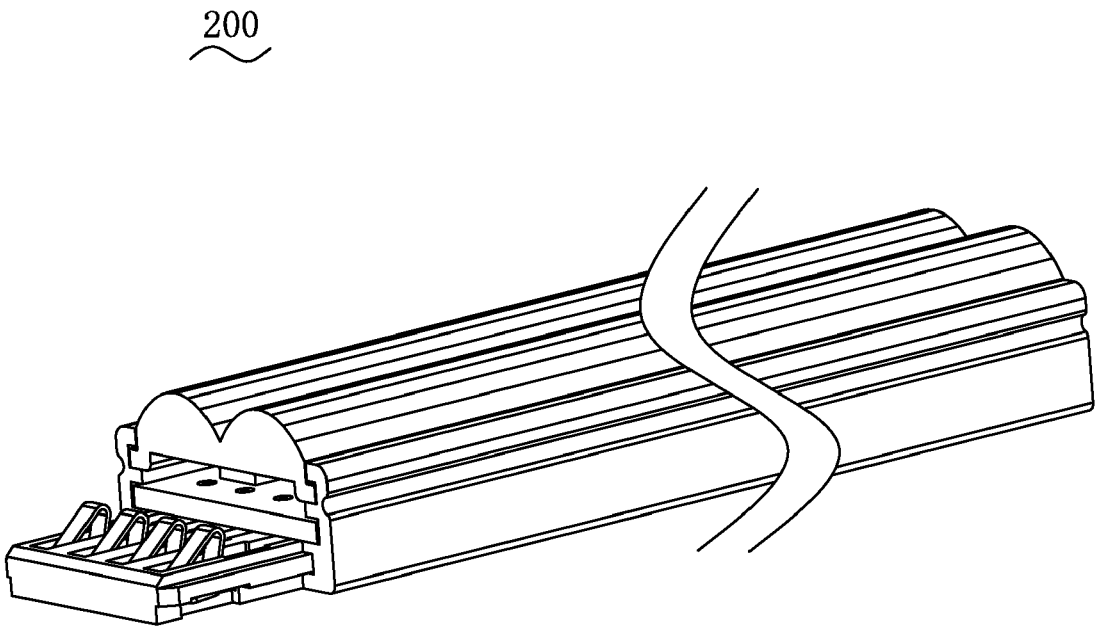
FIG. 4 is a perspective view of another embodiment of the LED lighting assembly.

FIG. 4 shows the second embodiment of the present invention. The LED lighting assembly 200 is double-row model, two rows LED untis are welded on the PCB.

The LED lighting assembly can link with another the same, and the distance of the LED units are same.

Although the present invention has been described with reference to the two embodiments, numerous modifications and veriations can be made by those skilled in the art without departing from the novel spirit and scope of this invention.

What is claimed is:

1. An LED lighting assembly comprising:

an emitting-light apparatus having a printed circuit board (PCB) with a front surface and at least one LED unit mounted on the front surface of the PCB and connected electrically to the PCB;

a base cover having a pair of grooves for receiving the emitting-light apparatus; and an inserting apparatus arranged beneath the PCB and slides into the base cover, the inserting apparatus being connected electrically to the PCB, wherein the inserting apparatus further comprises a pedestal with an upper surface, a bottom, and at least two connecting springs received in the pedestal, the two sides of the pedestal are extended sideways to form two strip inserting ribs, the upper surface of the pedestal having two receiving grooves for receiving two connecting springs.

2. The LED lighting assembly as set forth in claim 1, wherein the base cover has a first side groove, a second side groove, a bottom with two ends, and two inner side walls, the first and second side grooves being located on two inner side walls of the base cover and having a strip shape, the two ends of the bottom of the base cover has a fixing gap and an inserting slot, the emitting-light apparatus is inserted into the second side groove, the inserting apparatus having a inserting rib inserted into the first side groove, the bottom of the pedestal is received in the fixing gap, the bottom of the pedestal and the bottom of the base cover are leveled.

3. The LED lighting assembly as set forth in claim 2, the LED lighting assembly further comprising a light guiding lens having a strip shape, the light guiding lens projects upwardly to form an emitting body with two sides, each side of the emitting body extending to form a fixing rib, a third side groove is opened in the inner side walls of the base cover, the fixing rib inserts into the third side groove and above the emitting-light apparatus.

4. The LED lighting assembly as set forth in claim 3, further comprising a fixing dowel, a fixing hole is arranged in the PCB, a fastening hole is opened in the bottom of the base cover, the emitting-light apparatus is arranged in the base cover, the fixing dowel is inserted to the fastening hole and the fixing hole to fasten the emitting-light apparatus on the base cover.

5. The LED lighting assembly as set forth in claim 4, wherein the PCB having two ends and each end having a bottom with connecting pins and welding points, the receiving grooves projects to form at least two fixing poles, the connecting springs are arranged in the receiving grooves, and each connecting spring has a hole which covers around the fixing pole, the connecting springs are welded with welding points, the base cover projects upwardly to form a convex strip, the PCB presses against the convex strip.

* * * * *